US005761837A

United States Patent [19]

Tryon et al.

[11] Patent Number: 5,761,837

[45] Date of Patent: Jun. 9, 1998

[54] FIBER-OPTICS ILLUMINATED FUEL DISPENSER

[75] Inventors: John Frederick Tryon, Houston, Tex.; Ralph Robert Buoniconti, Jr., West Springfield, Mass.

[73] Assignee: Shell Oil Company, Houston, Tex.

[21] Appl. No.: 790,408

[22] Filed: Jan. 29, 1997

Related U.S. Application Data

[63] Continuation of Ser. No. 521,337, Aug. 29, 1995, abandoned, which is a continuation-in-part of Ser. No. 353,651, Dec. 9, 1994, abandoned.

[51] Int. Cl.[6] ..... G09F 13/00

[52] U.S. Cl. ..... 40/547; 362/32; 362/96

[58] Field of Search ..... 40/546, 547, 609; 362/32, 96; 222/14, 16, 23, 71, 72, 73, 74

[56] References Cited

U.S. PATENT DOCUMENTS

| | | | |
|---|---|---|---|
| 1,601,200 | 9/1926 | Davis | 362/96 X |
| 2,799,954 | 7/1957 | Donnelly et al. | 40/609 X |
| 4,296,562 | 10/1981 | Sanborn | 40/547 X |
| 4,856,392 | 8/1989 | Appelberg . | |
| 5,009,020 | 4/1991 | Watanabe | 40/547 |
| 5,019,748 | 5/1991 | Appelberg . | |
| 5,231,689 | 7/1993 | Reidinger . | |

FOREIGN PATENT DOCUMENTS

| | | | |
|---|---|---|---|
| 0 384 637 A1 | 8/1990 | European Pat. Off. . | |
| 0 563 467 A1 | 10/1993 | European Pat. Off. . | |
| 3128329 | 1/1983 | Germany . | |
| 2146583 | 6/1990 | Japan | 40/547 |
| 562755-A | 6/1975 | Switzerland . | |

OTHER PUBLICATIONS

Brochure: Prism Fiber Optics, Inc.
Specifications: 007 P.O.P. Illuminator.

*Primary Examiner*—Brian K. Green

[57] ABSTRACT

A panel assembly including a translucent panel and a fiber-optic strip disposed on the back of the translucent panel for imparting illumination to at least part of the translucent panel where the illumination of the fiber-optic strip by a light source results in illumination of the fiber-optic strip and at least part of the translucent panel.

1 Claim, 7 Drawing Sheets

FIBER-OPTICS ILLUMINATED FUEL DISPENSER

This is a continuation of application Ser. No. 08/521,337 filed Aug. 29, 1995, now abandoned, which is a continuation-in-part of Ser. No. 08/353,651 filed Dec. 9, 1994, now abandoned.

FIELD OF THE INVENTION

The invention relates to a system for illuminating a graphic and translucent panel, especially a graphic and panel which are part of a retail gasoline dispenser.

BACKGROUND OF THE INVENTION

Gasoline dispenser pumps are used in gasoline service stations to transfer the gasoline from the gasoline reservoir to the fuel tank of the customer's vehicle. Since gasoline is a flammable liquid, safety regulations limit the type of lighting that may be used in and around the dispenser. These regulations protect customers and employees from unsafe lighting systems which could ignite the gasoline in normal service or if a leak developed in the dispenser.

The limitations on such lighting cause corresponding limitations on the type of lighted advertising graphics which may be used on and around the gasoline dispenser. Fluorescent or incandescent light fixtures could light graphics on portions of the dispenser. It would be difficult, however, to meet the safety regulations with such lighting sources. The safety regulations include limits on the maximum voltage used in lighting advertising graphics. Another problem with those sources is their size. The lower door of the gasoline dispenser is a prime area for applying advertising graphics such as the company name and/or company trade or service mark. Yet there is only a very limited area behind the lower door for installing lighting apparatus.

Accordingly, it would be advantageous to have a safe and space-conserving lighting apparatus for use in applying lighted advertising graphics to the lower door of a gasoline dispenser pump, to the exterior side end panels, to the valance at the top of the dispenser and on and around the meter readout area.

SUMMARY OF THE INVENTION

The invention relates to a panel assembly, including a graphics panel, and a number of fiber-optic strands disposed to illuminate at least part of the graphics panel where the illumination of the light-receiving portions of the fiber-optic strands by a light source results in illumination of the light-emitting portions of the fiber-optic strands. The panel assembly is affixed to a gasoline dispenser's lower door on one or more sides of the dispenser, to the dispenser's exterior side end panels, to the valance at the top of the dispenser and/or on or around the meter readout area.

DETAILED DESCRIPTION OF THE INVENTION

A. Panel Assembly

Figure 1:
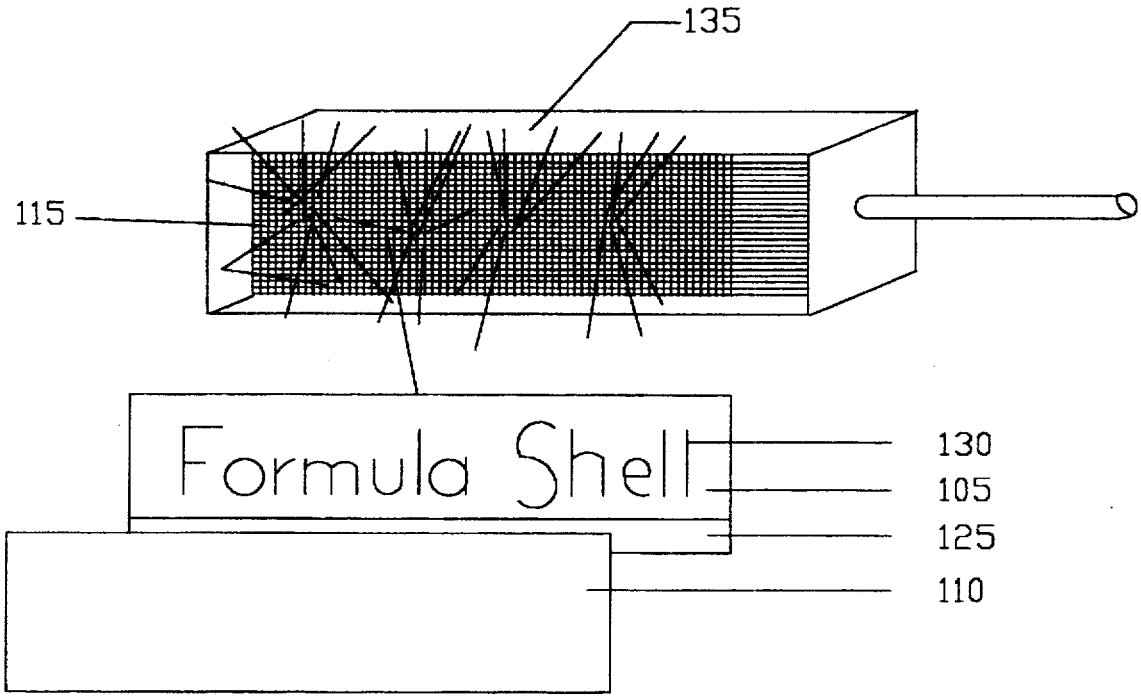
FIG. 1 is an exploded view of one embodiment of the panel assembly where utilization is made of fiber-optic strands having light-emitting side portions.

The panel assembly in one embodiment of the invention is discussed in detail below. In FIG. 1, graphic 105 is layered behind translucent panel 110 so as to impose a partly translucent, partly opaque graphic 105 on the translucent panel 110. Alternatively, graphic 105 is applied on the front of translucent panel 110. That approach however requires another translucent panel (not shown) in front of the graphic for protection. Graphic 105 is applied by any conventional graphic application means such as a label or silkscreen. Silkscreening is the most common and economical means of applying a graphic. Where the graphic is applied to a label, the label is layered on translucent panel 110 by any conventional means such as by an adhesive.

Translucent panel 110 is any conventional plastic, but preferably is a very strong material such as a polycarbonate plastic. General Electric sells one embodiment of a polycarbonate plastic panel under the trade name "LEXAN." Disposed behind graphic 105 is fiber-optic strip 115. Fiber-optic strip 115 is made up of one or more fiber-optic strands. Fiber-optic strip 115 can be of the type having side cuts in the fiber-optic strands for release of light. Such a fiber-optic strip is available from Fiberstars of Freemont, Calif. Alternatively, fiber-optic strip 115 can be a mat having numerous light-emitting end portions distributed along the surface of the mat. Such a mat-type fiber-optic strip is available from Lumitex of Ohio.

Where layering is used to apply the fiber-optic strip 115 to the back of the graphic, the strip is layered on the back of graphic 105 by any conventional means such an adhesive, or by any conventional attachment means such as tacking. The fiber-optic strip optionally is disposed behind the graphic, but is not directly attached to the graphic. The number of fiber-optic strips used can be one or more and will vary depending on the type of graphic being illuminated. Fiber-optic strips are optionally made of fiber-optic cable or strands or tubing arranged closely together, such as on a support material, to substantially provide an illuminated strip.

Figure 2B:
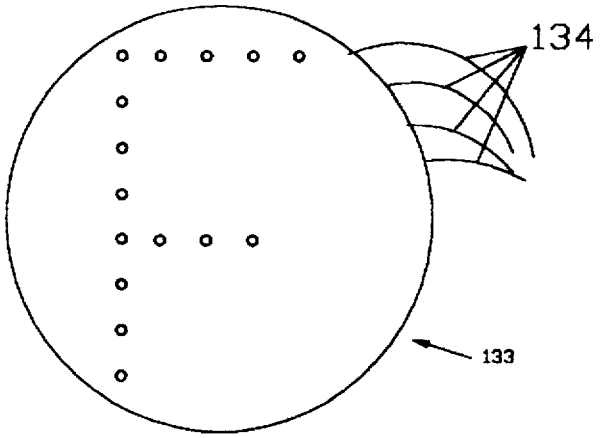
FIG. 2B is a blow-up view of a portion of FIG. 2A.
Figure 2C:
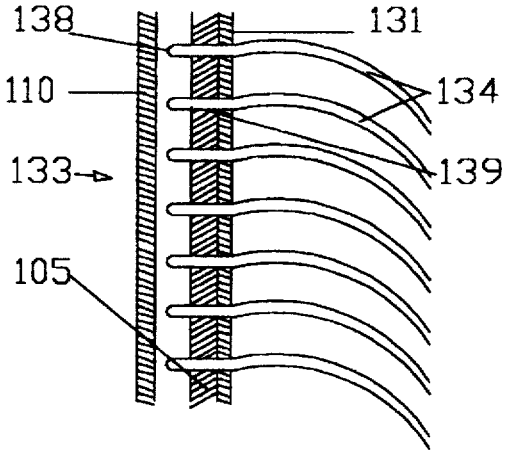
FIG. 2C is a side view of FIG. 2B.
Figure 2A:
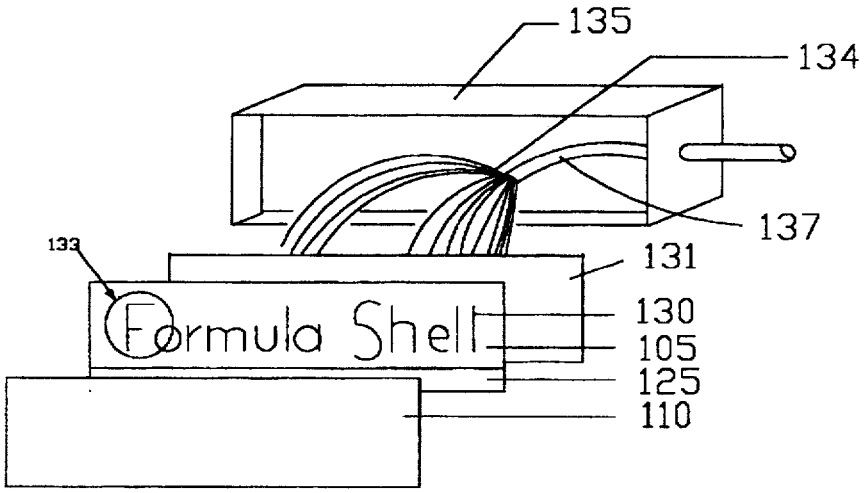
FIG. 2A is an exploded view of another embodiment of the panel assembly where utilization is made of fiber-optic strands having light-emitting end portions.

FIG. 2A is an exploded view of another embodiment of the panel assembly where utilization is made of fiber-optic strands having light-emitting end portions. In FIG. 2A fiber-optic strands or cable are used directly instead of in the form of fiber-optic strips. Fiber-optic strands or cable are known in the art from U.S. Pat. No. 5,231,689. The disclosure in this patent is incorporated herein by reference. Fiber-optic strands are available commercially from Prism Fiber Optics, Pittsburgh, Pa.

This embodiment is similar to that of FIG. 1 except as follows. Graphic 105 is layered on the front of panel 131. Where layered on the front, panel 131 is optionally translucent or opaque. Optionally, panel 131 is translucent and graphic 105 is layered on the back of panel 131. Fiber-optic strands 134 protrude from fiber-optic bundle 137. Individual fiber-optic strands 134 are positioned in channels 139 in FIG. 2C drilled into or through panel 131 and graphic 105. Where graphic 105 is on the front of panel 131 or on the back of panel 131 but the fiber-optic strands 134 protrude through the panel 131 and graphic 105, then panel 110 is a protection translucent panel.

Individual letters such as the letter "l" 130 or "F" 133 optionally make up at least a portion of graphic 105. FIG. 2B is a blow-up view of the letter "F" portion 133 of FIG. 2A. Optionally, letters such as "l" 130 or the entire graphic 105 may be coated with a containing micron size glass beads dispersed therein. Such "microbeads" are useful for dispersing the light emitted by light-emitting ends (138 in FIG. 2C) for wide-angle viewing. Such microbead coatings are taught in U.S. Pat. No. 5,231,689, which is incorporated herein by reference.

Individual fiber-optic strands 134 are positioned in thickness-wide channels 139 in FIG. 2C in graphic 105 and panel 131. Strands 134 are positioned in any position so as to illuminate, e.g., the letter "F" 133. The strands 134 can be positioned on the periphery of the letter "F" or scattered along the whole area of the letter "F" if the letter is in a block letter script or other sign script having some thickness.

FIG. 2C is a side view of FIG. 2B. As shown, the individual fiber-optic strands 134 protrude through channels 139 in panel 131 and graphic 105 to form portion 133. Light emitted from the light-emitting end portions 138 of fiber-optic strands 134 thus illuminate graphic portion 133.

When used in a gasoline dispenser pump, the use of light sources is typically governed by U.L. Specification No. 913 (or corresponding regulations, if any) safety regulations. Very significantly, this U.L. Specification is either met or inapplicable for the present invention, since the fiber-optic strands utilized carry no current into the gasoline pump assembly lower cavity. Thus, they do not pose a risk of being a source for igniting any gasoline vapors which may escape into the lower cavity from the pump assembly piping.

Other safety regulations or concerns may, however, be applicable. For example, to prevent any build-up of gasoline vapors in the case of a gasoline leak in the lower cavity of the gasoline pump assembly, the entrance of such vapors to fiber-optic bundle (137 of FIG. 2A) is prevented by use of a suitable sealing compound. The casing of the bundle is also optionally vented to further avoid any such build-up of gasoline vapors.

The dimensions of the fiber-optic strips will vary depending on their application. The panel assembly operates by illuminating the free end of fiber-optic strip 115 by a light source (not shown). The light source is typically an incandescent, halogen, or fluorescent lamp, or laser light emitting diode. The lamp is powered by a conventional power source (not shown). The strip is optionally layered on the back of graphic 105, for imparting illumination to at least part of graphic 105 and translucent panel 110. The illuminated fiber-optic strip 115 causes light to pass through graphic 105 and translucent panel 110. In FIG. 1, the graphic 105 forms letters of the alphabet 130, 133 and horizontal line 125. The light passes from strip 115 and through graphic 105 and panel 110, thus illuminating the letters 130, 133 and line 125 of graphic 105.

Optionally, protective container 135 is positioned by any conventional means behind fiber-optic strip 115. Protective container 135 serves to safeguard fiber-optic strip 115 and fiber-optic strands 134 from dust and/or moisture or other contaminants present in cavity 330 (see FIG. 3B). Protective container 135 is made of any conventional material suitable as a protective dust layer, such as metal, vinyl or other plastic material. Protective container 135 is optionally fixedly attached to portions of lower door 310 (see FIGS. 3A–B).

Protective container 135 can have a varying depth sufficient to accommodate the fiber-optic strip or tubing or cable. For example, the depth of protective container 135 is optionally from about 0.25 inches to about 3 inches. Since the depth space in cavity 330 is limited due to mechanical apparatus in the cavity, the depth of protective container 135 is also limited.

B. Panel Assembly Affixed to Gasoline Dispenser Pump

1. Affixed to Lower Door

Figure 3A:
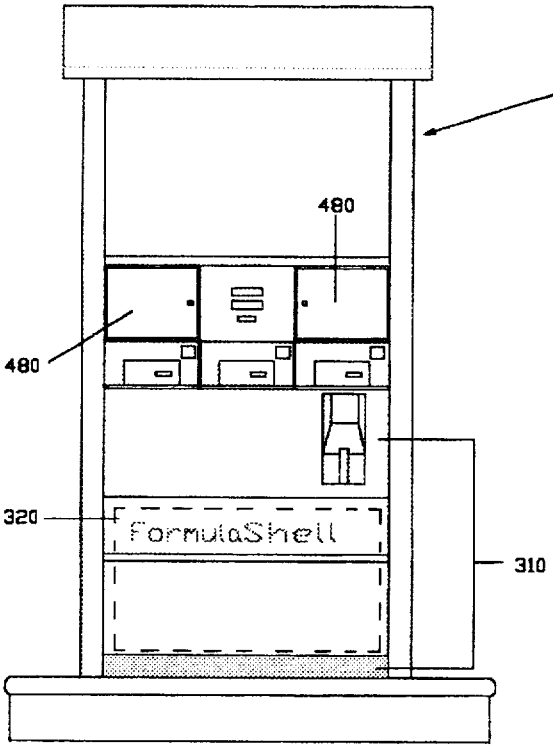
FIGS. 3A and 3B depict a front view and a side view of one embodiment of the panel assembly affixed to the lower door of a gasoline dispenser pump.
Figure 3B:
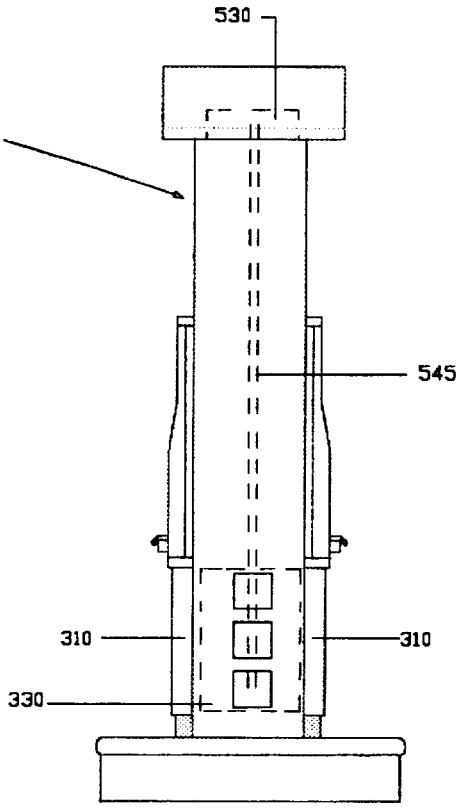

In FIGS. 3A and 3B, an embodiment of the invention is shown where the panel assembly is affixed to the lower door of a gasoline dispenser pump. In FIG. 3A, gasoline dispenser pump 300 houses lower door 310. Panel assembly 320 is affixed to lower door 310. The attachment may be by any conventional means. Panel assembly 320 is optionally recessed from, or substantially flush with, the outer surface of lower door 310. When recessed, the amount of recess is limited to the available space behind lower door 310 since pump apparatus occupies most of cavity 330 (FIG. 3B) behind lower door 310.

Typically, as indicated in FIG. 3B, pump 300 will have two lower doors 310. They are typically mounted on opposite sides of pump 300. As a result, panel assembly 320 is optionally removably mounted on one or two sides of gasoline dispenser pump 300.

As depicted in FIG. 3B, the sides of a lower portion of gasoline dispenser pump lower doors 310, and other side portions, define sides of cavity 330. The panel assembly is removably mounted on a lower portion of gasoline dispenser pump 300, i.e., lower door 310. Thus, a back portion of panel assembly 320 defines one side of cavity 330.

The panel assembly is maintained either by rear or frontal access. Where protective container 135 is used (see FIGS. 1, 2A), rear access is possible where it is removably attached to lower door 310. Frontal access is possible where translucent panel 110 is removably mounted.

The panel dimensions are adjusted as necessary to fit the particular gasoline dispenser pump. When used in gasoline dispenser pump 300, the panel assembly dimensions are as follows (reference FIGS. 1, 2A): (1) Translucent panel 110 is from about 5 inches to about 20 inches in height, from about 20 inches to about 72 inches in length, and from about 1 inch to about 6 inches in thickness, including protective container 135. It is preferable to maximize the depth of protective container 135 so as to avoid bending the fiber optic strands any more than necessary. The depth of protective container 135 is limited by the particular gasoline pump assembly in which this panel assembly is installed. The height and length of graphic 105 and protective container 135 correspond to the height and length of translucent panel 110. Where fiber-optic strip 115 is a mat, it typically has dimensions of from about 1 inch to about 10 inches in height and from about 5 inches to about 36 inches in length.

2. Affixed to Side Portion or Top Portion

Figures 4A, 4B:
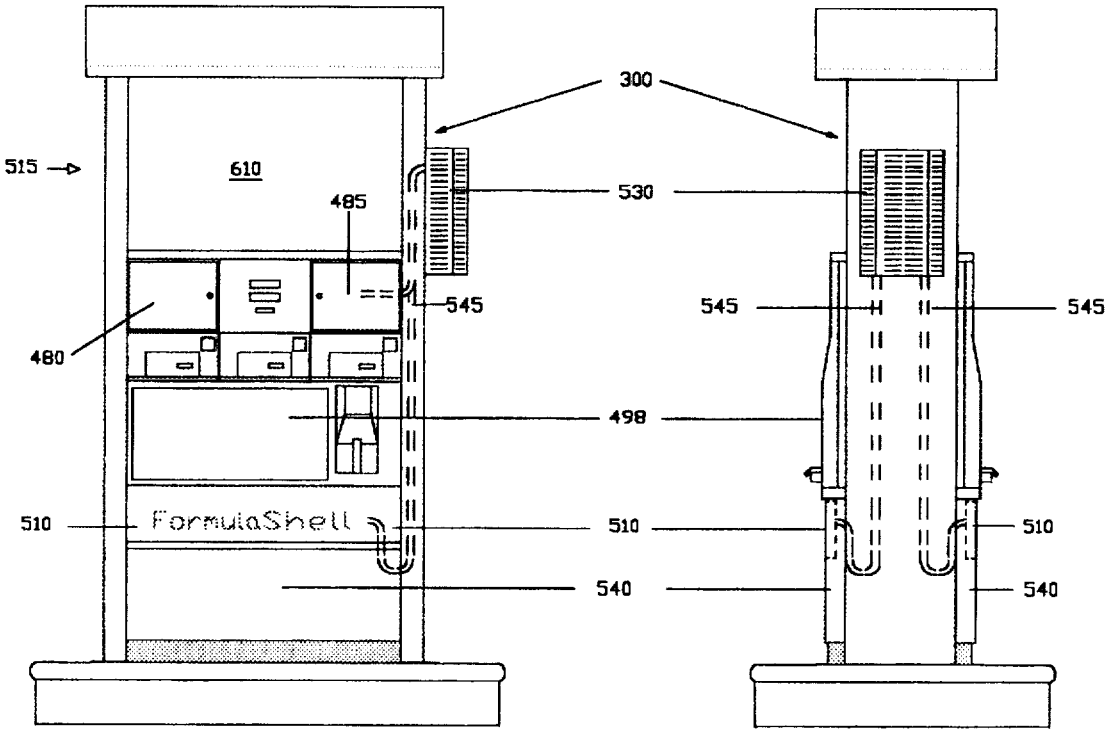
FIGS. 4A and 4B depict front and side views, respectively, of the panel assembly affixed to a front access panel and having light-receiving portions of the fiber-optic strands remotely located in a control box on a side portion of a gasoline dispenser pump.
Figures 5A, 5B:
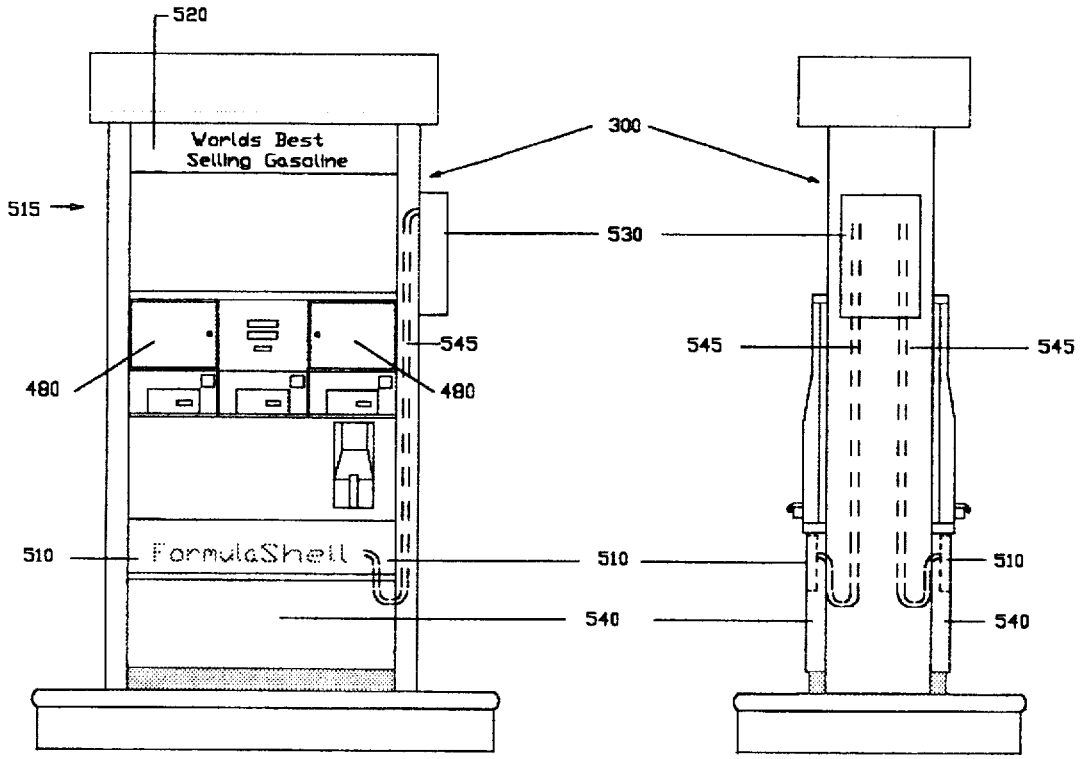
FIGS. 5A and 5B depict one embodiment of a front and side view, respectively, of one graphics panel assembly affixed to a front lower door and another graphics panel assembly affixed in a top portion of an upper hollow portion of the gasoline dispenser, where the graphics panel attached to the lower door has light-receiving ends of the fiber-optic strands remotely located in a control box depicted in FIG. 5B.
Figures 6A, 6B:
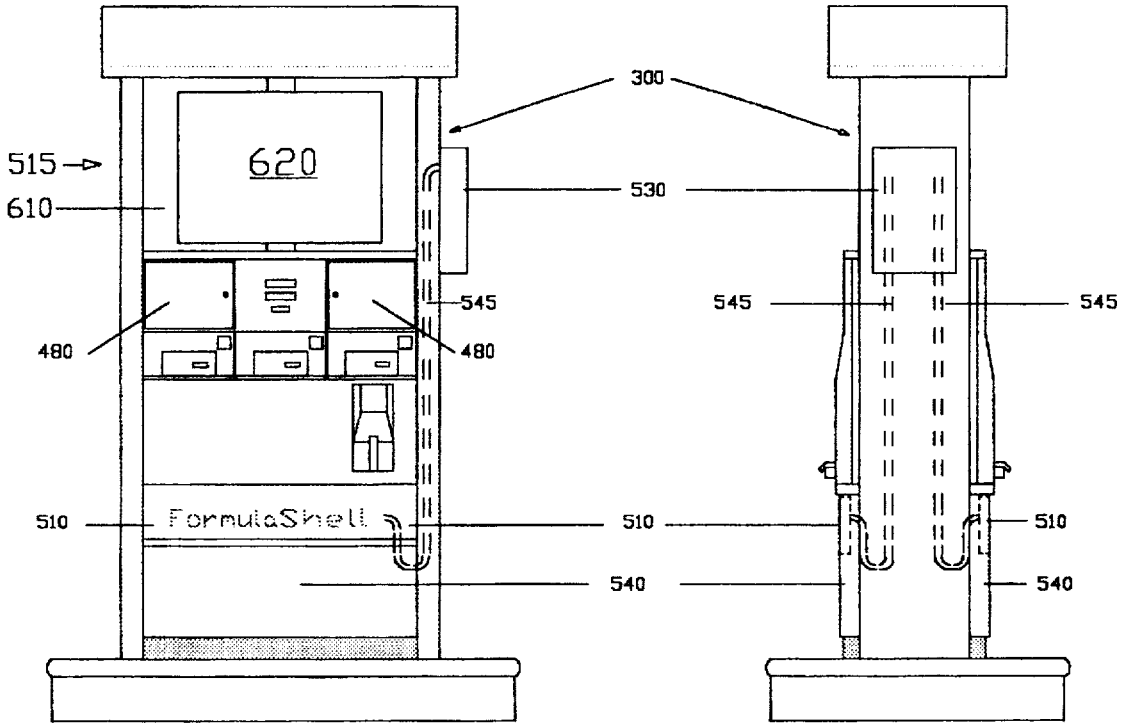
FIGS. 6A and 6B depict another embodiment of a front and side view, respectively, of one graphics panel assembly affixed to a front lower door and another graphics panel assembly affixed in the center of an upper hollow portion of the gasoline dispenser, where the graphics panel attached to the lower door has light-receiving ends of the fiber-optic strands remotely located in a control box depicted in FIG. 6B.
Figures 7A, 7B:
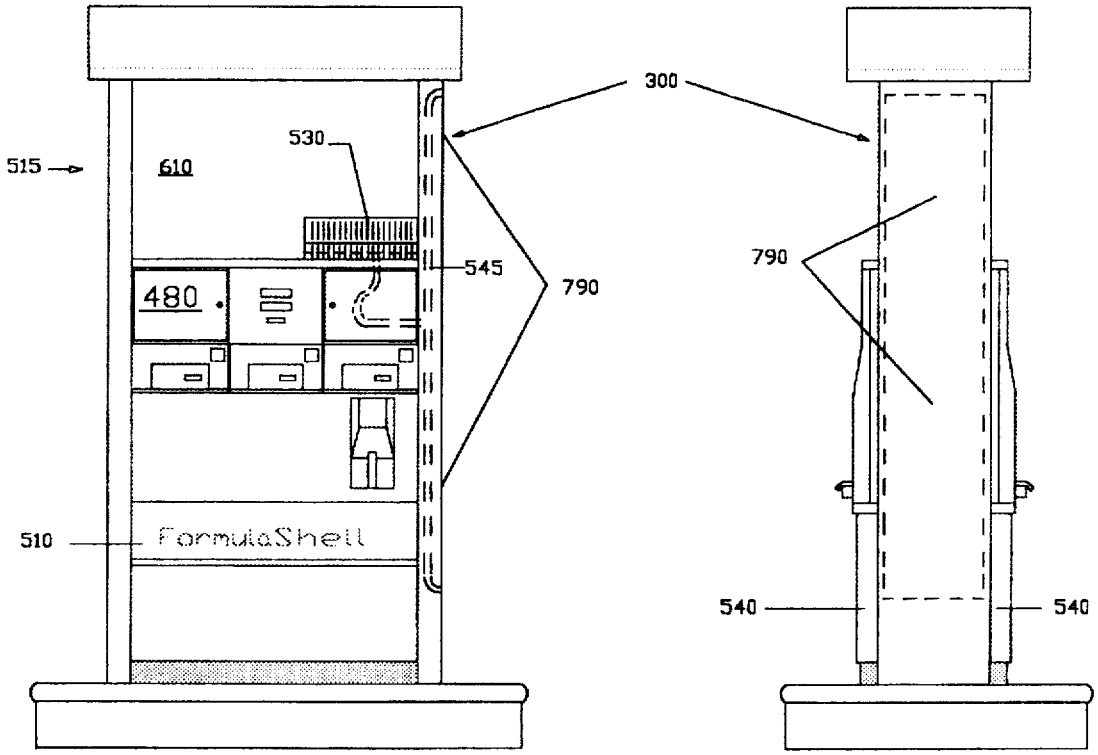
FIGS. 7A and 7B depict another embodiment of a front and side view, respectively, of one graphics panel assembly affixed to a front lower door and another graphics panel assembly affixed to a side portion of the gasoline dispenser, where both graphics panels have light-receiving ends of the fiber-optic strands remotely located in a control box depicted in FIG. 7A.

FIGS. 4A–B, 5A–B, and 7A–B show various embodiments of the graphics panel affixed to side and top portions of the dispenser 300. Where explosive gases are present at the portion of the pump assembly where the graphics panel is affixed, the light-receiving ends of the fiber-optic strands are located remotely from the graphics panel and remotely from the portion of the pump assembly on which the graphics panel is affixed.

Where explosive gases are not present, the light-receiving end portions of the fiber-optic strands are optionally housed together with the graphics panel and light-emitting end portions of the fiber-optic strands.

a. FIGS. 4A and 4B:

FIGS. 4A and 4B depict one embodiment of a front and side view, respectively, of one graphics panel assembly 510 affixed to a front lower door 540, another graphics panel assembly 498 affixed to a front portion of the gasoline dispenser, and another graphics panel assembly 485 affixed in, or in place of, one of two front access panels 480 of the gasoline dispenser. Optionally, both front access panels 480 are affixed to or replaced by graphics panels 485. Two graphics panels 510 are optionally attached to the lower doors 540 on both front and back of the gasoline pump dispenser assembly. Light-receiving ends (not shown) of the fiber-optic strands 545 for graphics panels 510 and graphics panel 485 are remotely located in control box 530.

b. FIGS. 5A and 5B:

FIGS. 5A and 5B depict one embodiment of a front and side view, respectively, of one graphics panel assembly 510 affixed to a front lower door 540 and another graphics panel assembly 520 affixed in a top portion 515 of an upper hollow portion of the gasoline dispenser. Two graphics panels 510 are optionally attached to the lower doors 540 on both front and back of the gasoline pump dispenser assembly. Light-receiving ends (not shown) of the fiber-optic strands 545 are remotely located in control box 530 as depicted in FIG. 5B.

c. FIGS. 6A and 6B:

FIGS. 6A and 6B depict another embodiment of a front and side view, respectively, of one graphics panel assembly 510 affixed to a front lower door 540 and another graphics panel assembly 620 affixed in the center of an upper hollow portion 610 of the gasoline dispenser, where the graphics panel attached to the lower door has light-receiving ends of the fiber-optic strands 545 remotely located in a control box 530 depicted in FIG. 6B. Except for graphics panel 620 located in hollow 610, the elements are numbered the same as in FIGS. 5A and 5B. Graphics panel 620 is optionally self-contained, i.e., the light-receiving ends of the fiber-optic strands are not located remotely but are housed proximate to the graphics panel. Optionally, graphics panel 620 is two-sided, i.e., having a front and a back graphics panel with each having the same or different advertising copy.

d. FIGS. 7A and 7B:

FIGS. 7A and 7B depict another embodiment of a front and side view, respectively, of one graphics panel assembly 510 affixed to a front lower door 540 and another graphics panel assembly 790 affixed to a side portion of the gasoline dispenser, where both graphics panels have light-receiving ends of the fiber-optic strands 545 remotely located in a control box 530 depicted in FIG. 7A. Optionally, the side graphics panel assembly 790 is configured to appear as a standard side panel except when illuminated. That is, the advertising copy and/or graphics are not visible unless the fiber-optic strands are illuminated.

What is claimed is:

1. In a gasoline dispenser pump assembly, said pump assembly including a top panel, a front panel, a rear panel and two side panels, wherein said front, rear and side panels define sides of a cavity and wherein said cavity is subject to exposure to explosive gases and is made accessible by at least one door removably attached to said gasoline pump assembly, the improvement comprising:

(a) a graphics panel having front and back surfaces and having a graphic image layered on at least one of said surfaces for depicting illuminated advertising copy to the public, said graphics panel being removably mounted on said at least one door; and (b) a plurality of fiber-optic strands having their light-receiving end portions located in a control box, said control box having a light source, said control box being located remotely from said cavity of said gasoline dispenser pump assembly and said fiber-optic strands having their light-emitting end portions located in said cavity of said gasoline dispenser pump assembly and being positioned in relation to said graphics panel so as to illuminate at least a portion of said graphic image layered on said graphics panel when light is received by said light-receiving end portions located in said control box.

* * * * *